US011457315B2

(12) United States Patent
Xiao et al.

(10) Patent No.: US 11,457,315 B2
(45) Date of Patent: Sep. 27, 2022

(54) SPEAKER

(71) Applicant: Tymphany worldwide Enterprises Limited, Grand Cayman (KY)

(72) Inventors: Peng Xiao, Grand Cayman (KY); Zhi Li, Grand Cayman (KY)

(73) Assignee: TYMPHANY WORLDWIDE ENTERPRISES LIMITED, Grand Cayman (KY)

( * ) Notice: Subject to any disclaimer, the term of this patent is extended or adjusted under 35 U.S.C. 154(b) by 0 days.

(21) Appl. No.: 17/393,850

(22) Filed: Aug. 4, 2021

(65) Prior Publication Data

US 2022/0046359 A1 Feb. 10, 2022

(30) Foreign Application Priority Data

Aug. 4, 2020 (CN) ..... 202010772047.5

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 7/14*** | (2006.01) |
| ***H04R 9/04*** | (2006.01) |

(52) U.S. Cl.

CPC ..... *H04R 9/02* (2013.01); *H04R 7/14* (2013.01); *H04R 7/18* (2013.01); *H04R 9/022* (2013.01); *H04R 9/041* (2013.01); *H04R 9/046* (2013.01); *H04R 9/06* (2013.01); *H04R 2400/11* (2013.01)

(58) Field of Classification Search

CPC ... H04R 7/14; H04R 7/18; H04R 9/02; H04R 9/022; H04R 9/041; H04R 9/043; H04R 9/046; H04R 9/06; H04R 2400/11

See application file for complete search history.

(56) References Cited

U.S. PATENT DOCUMENTS

| | | | | |
|---|---|---|---|---|
| 5,734,734 A * | 3/1998 | Proni | ..... | H04R 9/02 381/432 |
| 2008/0304694 A1* | 12/2008 | Hayashi | ..... | H04R 9/022 381/397 |
| 2011/0044491 A1* | 2/2011 | Ku | ..... | H04R 9/06 381/433 |

* cited by examiner

*Primary Examiner* — Huyen D Le

(74) *Attorney, Agent, or Firm* — Muncy, Geissler, Olds & Lowe, P.C.

(57) ABSTRACT

A speaker includes a basket; a diaphragm, supported on the basket through a surround; and a voice coil, including a cup-shaped support connected to the basket through a damper. An upper periphery of the cup-shaped support includes protrusion portions in contact with a lower surface of the diaphragm and grooves spaced apart from the diaphragm. The grooves extend in radial directions of the cup-shaped support to form air passages.

10 Claims, 6 Drawing Sheets

SPEAKER

CROSS REFERENCE TO RELATED APPLICATIONS

The present application claims priority to Chinese Patent Application No. CN 202010772047.5, which was filed on Aug. 4, 2020, the entire contents of which are hereby incorporated by reference.

BACKGROUND

Technical Field

The present invention relates to the field of audio equipment, and more specifically, to a speaker.

Related Art

When the speaker is in use, a surface of a diaphragm has to be cooled. The cooling design in the art is usually to form a hole on the bottom of a U-shaped yoke, forming a hole on a voice coil frame, and/or forming a hole on a cup-shaped support.

Forming the hole on the bottom of the U-shaped yoke is able to cool the voice coil, thereby cooling the diaphragm. However, the disadvantage is that, for an ultra-thin speaker having limitations on structural layout, the U-shaped yoke has to be disposed outside the speaker box. If the hole is formed on the U-shaped yoke, the speaker box could not be sealed, and wind noise is also generated significantly. In addition, forming the hole on the bottom of the U-shaped yoke may also increase the manufacturing cost.

For the solution of forming a hole on the voice coil frame and forming a hole on the cup-shaped support, airflows do not pass through the surface of the diaphragm, which has limited cooling effects on the diaphragm.

SUMMARY

For technical issues existing in the art, an object of the present invention is to provide a speaker to at least enhance a cooling effect of a diaphragm while maintaining the sound quality.

In order to achieve the above objective, the present invention provides a speaker, including a basket; a diaphragm, supported on the basket through a surround; and a voice coil, including a cup-shaped support connected to the basket through a damper, an upper periphery of the cup-shaped support including a plurality of protrusion portions in contact with a lower surface of the diaphragm and a plurality of grooves spaced apart from the diaphragm, wherein the grooves extends in radial directions of the cup-shaped support to form air passages.

According to at least one embodiment of the present invention, an end portion of each of the grooves in the radial directions includes a chamfered structure.

According to at least one embodiment of the present invention, the diaphragm includes a wall extending downwards from the lower surface, the wall including a plurality of connecting portions in contact with the protrusion portions.

According to at least one embodiment of the present invention, the wall further includes a plurality of extension portions extending in the radial directions from two ends of each of the connecting portions, and the extension portions being configured to guide airflows flowing through the air passages.

According to at least one embodiment of the present invention, the protrusion portions and the grooves are in an alternate arrangement.

According to at least one embodiment of the present invention, a distance between two adjacent grooves of the grooves is fixed.

According to at least one embodiment of the present invention, a hole is formed on the basket for the air passages.

According to at least one embodiment of the present invention, the cup-shaped support is formed by a wall extending continuously.

According to at least one embodiment of the present invention, the voice coil further comprises a voice coil frame configured to fix the cup-shaped support, the voice coil frame being connected to the cup-shaped support through gluing.

According to at least one embodiment of the present invention, an adhesive configured to glue the voice coil frame to the cup-shaped support does not go beyond surfaces of the grooves.

A beneficial technical effect of the present invention lies is that through the structure of the cup-shaped support of the voice coil of the present invention, the sound quality of the speaker is maintained, while the cooling effect on the diaphragm is enhanced and manufacturing cost is reduced.

BRIEF DESCRIPTION OF THE DRAWINGS

The aspects of the present invention will become more comprehensible from the following detailed description made with reference to the accompanying drawings. It should be noted that, according to the standard practices in the industry, components are not drawn to scale. In fact, for clarity of description, sizes of the components can be increased or decreased randomly.

DETAILED DESCRIPTION

Figure 1:
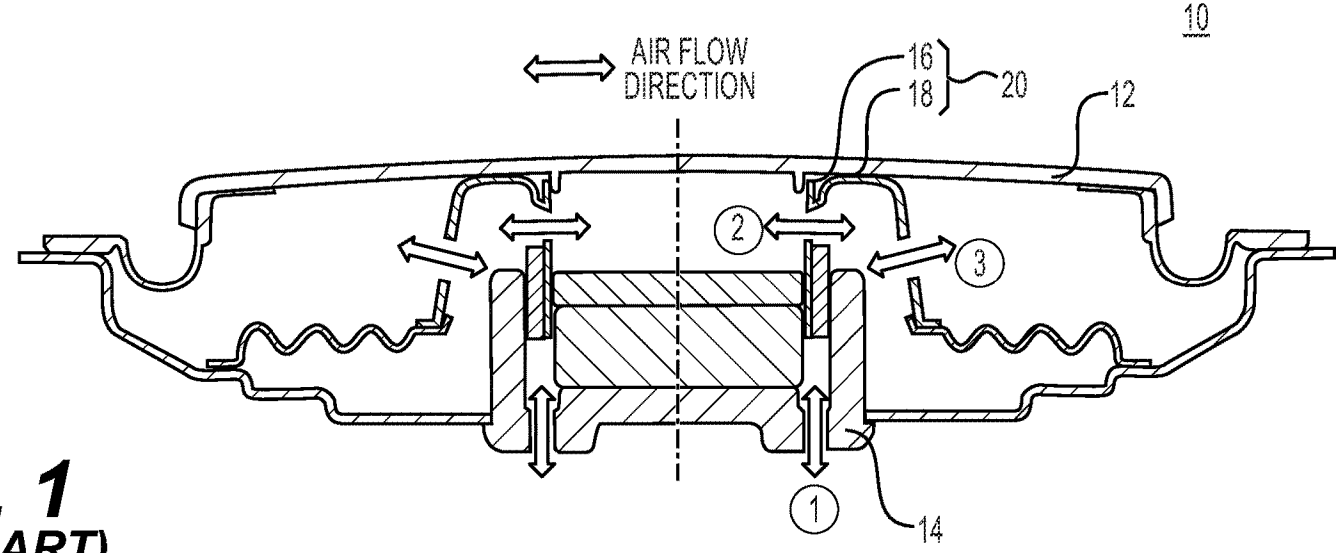
FIG. 1 (PRIOR ART)
FIG. 1 is a cross-sectional view of a speaker in the art.

The following disclosure provides different embodiments or examples for implementing different features of the provided subject matter. Specific examples of assemblies and arrangements are described below to simplify the present invention. Certainly, these are merely examples and are not intended to limit the present invention. For example, the following description includes an embodiment in which a first component is formed above or on a second component, and the first component is in direct contact with the second component, and the following description may also include an embodiment in which an extra component is formed between the first component and the second component such that the first component may not be in direct contact with the second component. In addition, in the present invention, reference numerals and/or characters may be repeated in embodiments. The repetition is for simplicity and clarity, which itself does not indicate a relationship between the embodiments and/or configurations discussed.

For ease of description, spatially relative terms such as "under", "below", "bottom", "on" and "top" may be used herein to describe a relationship between one element or component and another (or some other) elements or components shown in the figures. In addition to orientations shown in the figures, the spatially relative terms are intended to cover different orientations of the device in use or operation. An apparatus may be oriented in other ways (rotated 90 degrees or at other orientations), and the spatially relative descriptors used herein may also be used for corresponding explanation.

Referring to the figures, a speaker of the present invention is described below. It should be understood that the following descriptions are merely schematic embodiments of the present invention, and each of the embodiments does not constitute any special limitation on the present invention.

Figure 2:
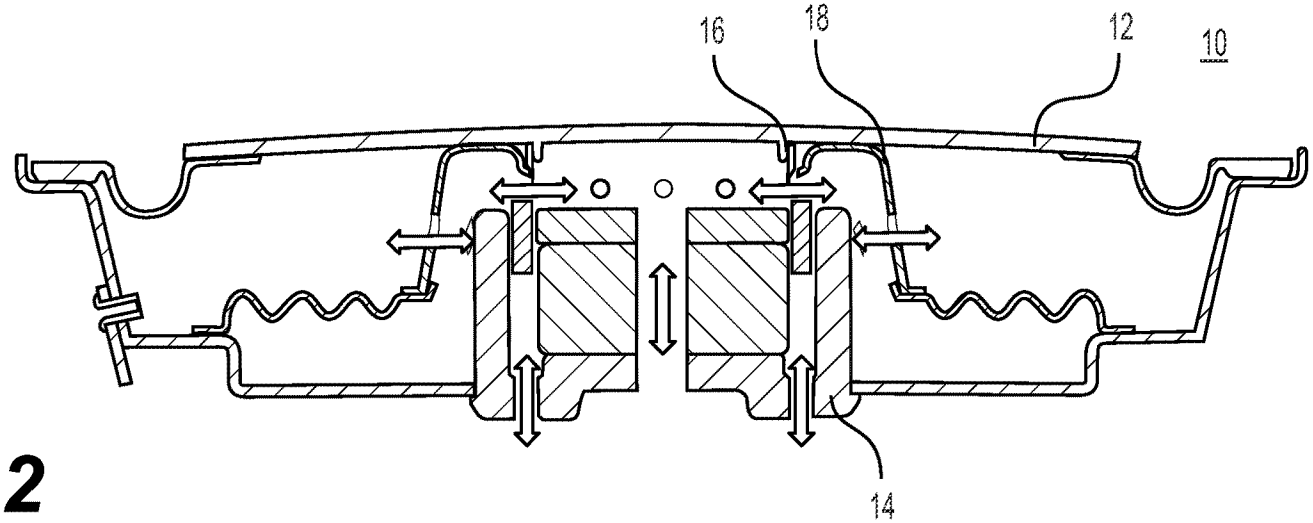
FIG. 2 (PRIOR ART)
FIG. 2 is another cross-sectional view of a speaker in the art.
Figure 3:
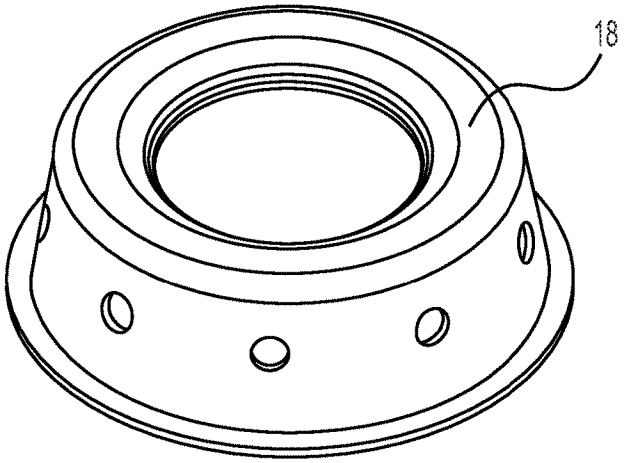
FIG. 3 (PRIOR ART)
FIG. 3 is a 3-dimensional view of a cup-shaped support of a speaker in the art.
Figure 4:
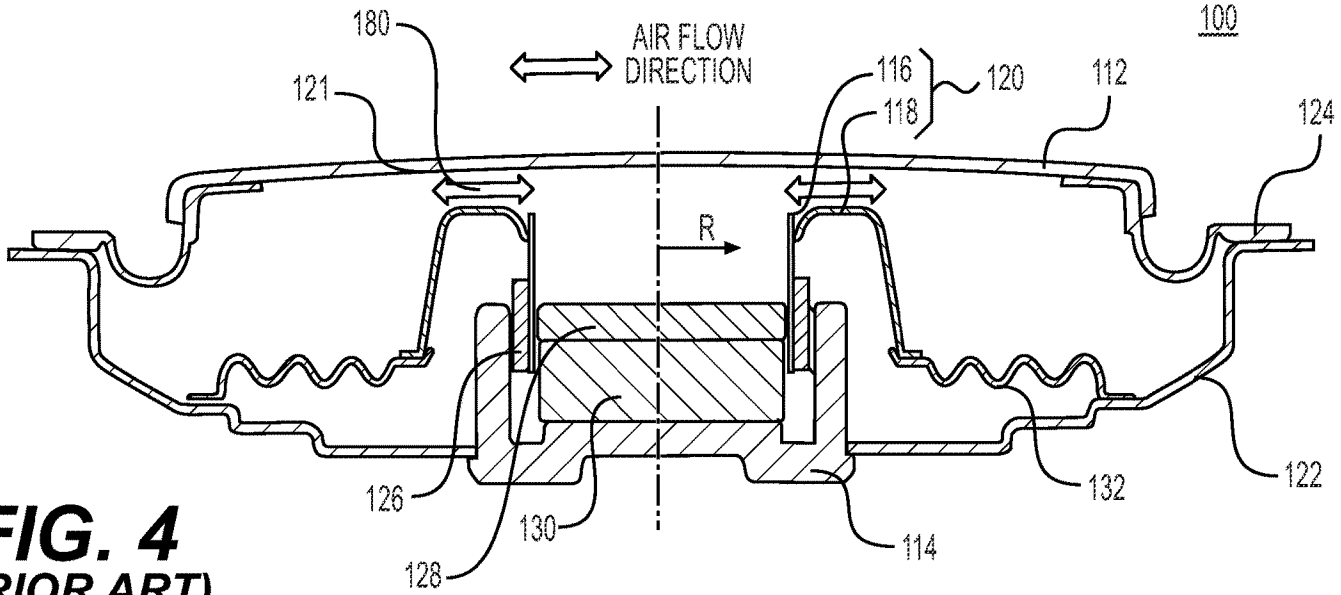
FIG. 4 (PRIOR ART)
FIG. 4 is a cross-sectional view of a sensor according to an embodiment of the present invention.
Figure 5:
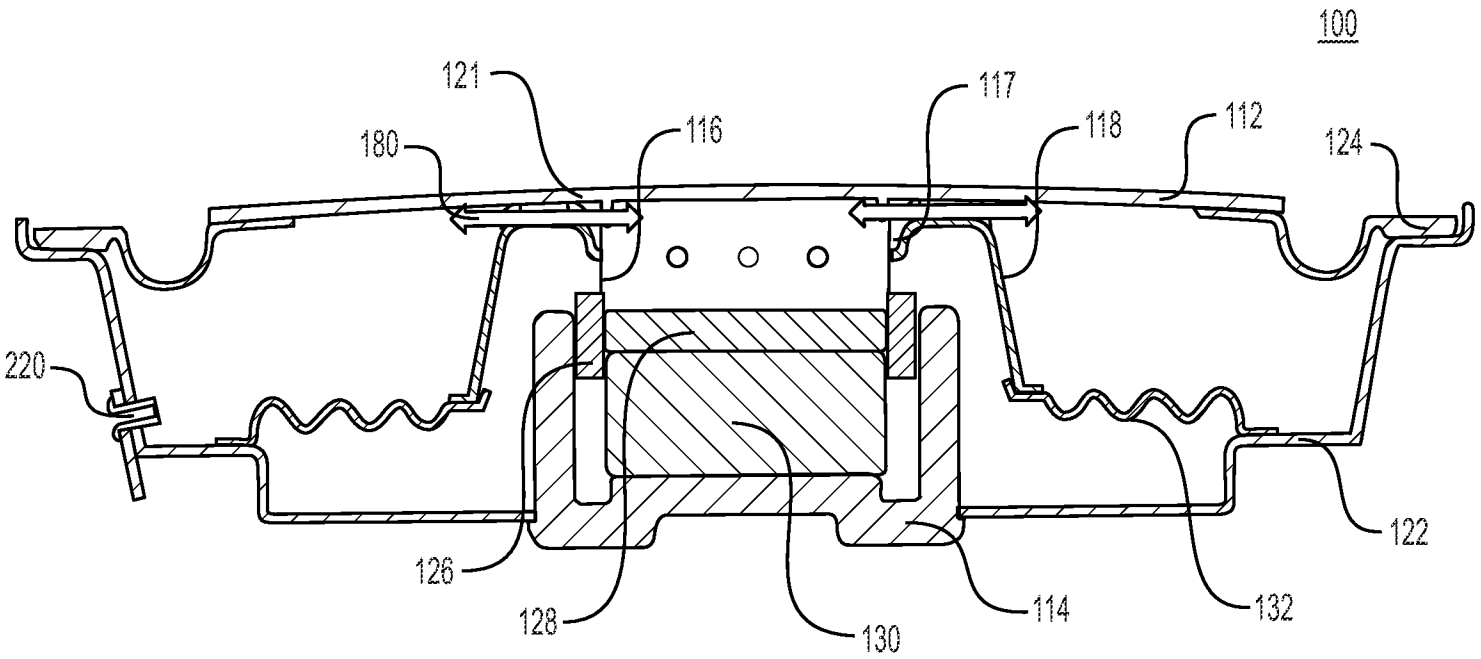
FIG. 5 is another cross-sectional view of the speaker according to the embodiment of the present invention.

FIG. 1 to FIG. 3 illustrate a solution for cooling a surface of a diaphragm 12 of a speaker 10 in the art. As shown in FIG. 1 to FIG. 3, the cooling design in the art typically forms a hole on the bottom of a U-shaped yoke 14 (a flowing direction of an airstream is shown by an arrow ①), to form a hole on a voice coil frame 16 (the flowing direction of the airstream is shown by an arrow ②), or to form a hole on a cup-shaped support 18 (the flowing direction of the airstream is shown by an arrow ③).

Forming the hole on the bottom of the U-shaped yoke 14 can cool the voice coil 20, thereby cooling the diaphragm 12. However, the disadvantage lies in that, for an ultra-thin speaker, due to the limitation on structure, the U-shaped yoke 14 has to be exposed outside the speaker box. If the hole is formed on the U-shaped yoke 14, the sealing of the speaker box cannot be achieved, and wind noise is also generated. In addition, forming the hole on the bottom of the U-shaped yoke 14 also increases manufacturing cost.

For the solution of forming the hole on the voice coil frame 16 and forming the hole on the cup-shaped support 18, airflows do not pass through the surface of the diaphragm 12, which has limited cooling effects on the diaphragm 12.

For the cooling design in the art, up-and-down movement of the diaphragm 12 changes airflows to achieve convection (as shown by the arrows ①, ②, and ③) through a rear hole on the bottom of the U-shaped yoke 14 or side holes of the voice coil frame 16 and the cup-shaped support 18. The heat of the voice coil 20 can be dissipated. However, heat transferred to the surface of the diaphragm 12 from the voice coil 20 is still significant, and therefore the temperature on the surface of the diaphragm is still high.

Referring to FIG. 4 to FIG. 8, a speaker 100 according to an embodiment of the present invention is shown. The speaker 100 includes a basket 122 and a diaphragm 112. The diaphragm 112 is supported on the basket 122 through a surround 124. The speaker 100 further includes a voice coil 120. The voice coil 120 includes a cup-shaped support 118 connected to the basket 122 through a damper 132. An upper periphery of the cup-shaped support 118 includes plural protrusion portions 181 in contact with a lower surface 121 of the diaphragm 112 and plural grooves 182 spaced apart from the diaphragm 112. The grooves 182 extend in radial directions R of the cup-shaped support 118 to form air passages 180. The air passages 180 allow airflows to circulate on the surface of the diaphragm 112 and have significant cooling effects on the surface of the diaphragm 112. In addition, no holes are formed on the U-shaped yoke 114, so that sound of the speaker 100 is clear, and manufacturing costs is reduced.

Figure 6:
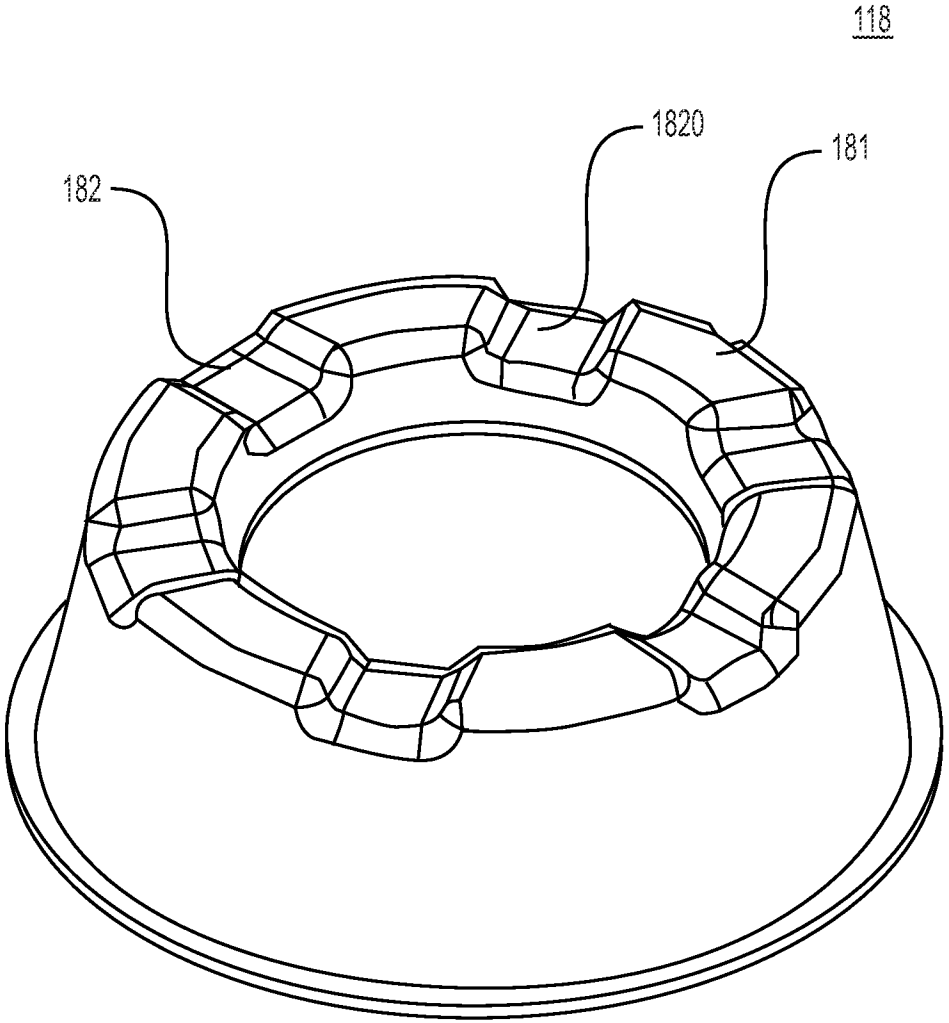
FIG. 6 is a 3-dimensional view of a cup-shaped support of the speaker according to the embodiment of the present invention.

Referring to FIG. 6 for detail, in one embodiment, an end portion of each of the grooves 182 in corresponding radial direction R includes a chamfered structure 1820. The chamfered structure 1820 can reduce the resistance of circulation of airflows, so as to enhance the cooling effect and further decrease the noise of the airflows. In one embodiment, the grooves 182 can be configured into different shapes, and cross-sections of the grooves 182 in vertical and radial directions can be rectangles, trapezoids, or the like. The shapes of the grooves 182 can be modified according to the shape of the speaker 100. The grooves 182 can also be configured into suitable sizes, for example, sizes of internal openings are larger than sizes of external openings, the sizes of external openings are larger than the sizes of internal openings, and the sizes of external openings are equal to the sizes of internal openings. The sizes of the grooves 182 can be modified according to the shape of the speaker 100.

Figure 7:
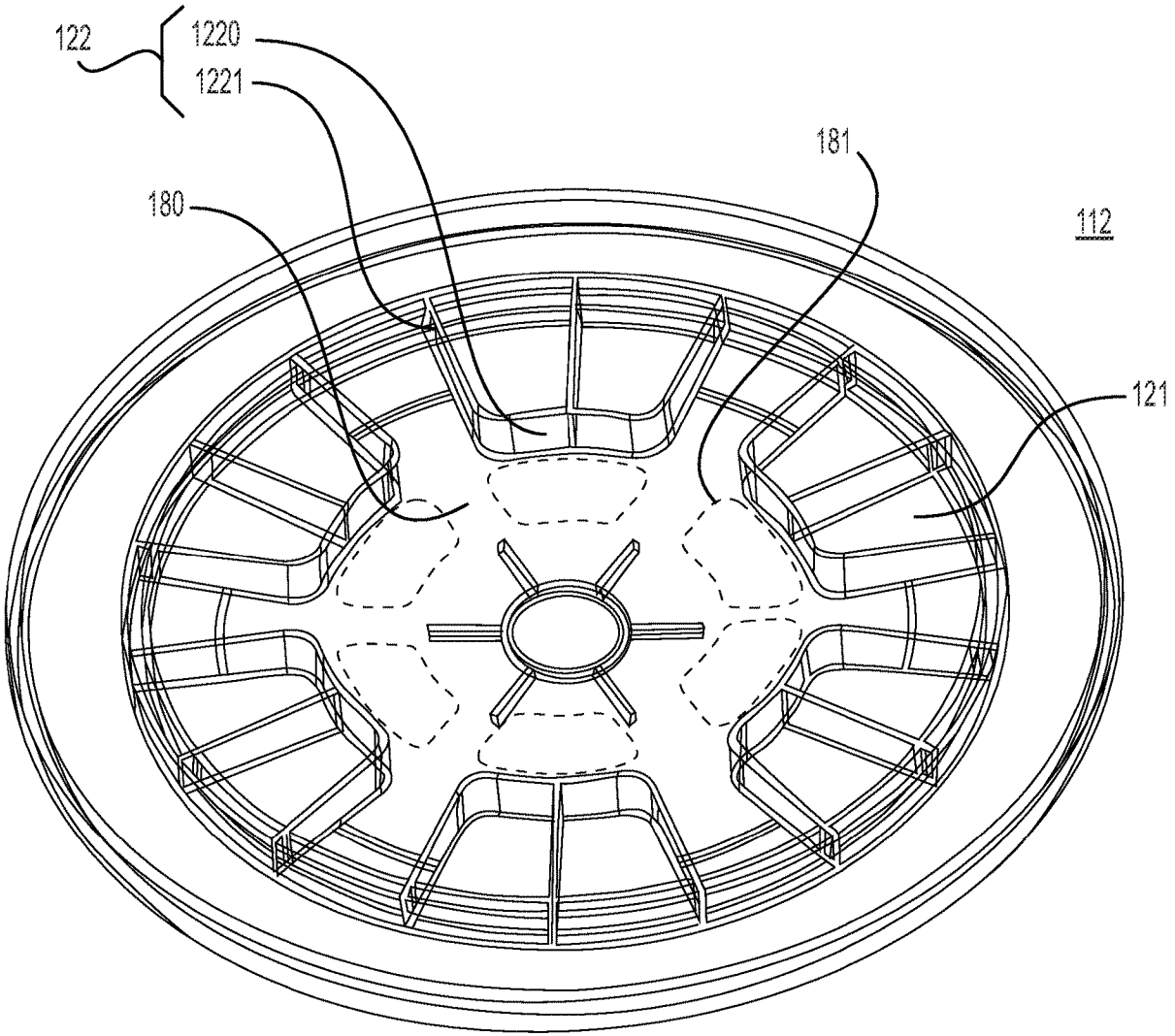
FIG. 7 is a 3-dimensional view of a diaphragm of the speaker according to the embodiment of the present invention.

Referring to FIG. 7, in one embodiment, the lower surface 121 of the diaphragm 12 is shown. The diaphragm 112 includes a wall 122 extending downwards from the lower surface 121. The wall 122 includes plural connecting portions 1220 in contact with the protrusion portions 181. The dotted lines in FIG. 7 are parts that the protrusion portions 181 are in contact with the lower surface 121. That is, the dotted lines in FIG. 7 are top surfaces of the protrusion portions 181. Therefore, the connecting portions 1220 limit the displacement of the protrusion portions 181 in the radial direction R; that is, the movement of the protrusion portions 181 is limited in a space defined by the connecting portions 1220 in the radial direction R. The grooves 182 are lower than the protrusion portions 181 and, therefore, are not in contact with the lower surface 121 of the diaphragm 112, so as to form air passages 180 between two adjacent two dotted portions (two adjacent protrusion portions 181).

In one embodiment, the wall 122 further includes plural extension portions 1221 extending in the radial directions R from two ends of each of the connecting portions 1220. The extension portions 1221 are configured to guide airflows flowing through the air passages 180.

In one embodiment, the protrusion portions 181 and the grooves 182 are in an alternative arrangement. A distance between two adjacent grooves 182 may be fixed.

In one embodiment, a hole 220 is formed on the basket 122 and in communication with the air passages 180. The airflows can circulate with the outside through the hole 220. In one embodiment, the cup-shaped support 118 is formed by a wall forming extending continuously. That is, no hole is formed on the cup-shaped support 118. In one embodiment, the voice coil 120 further includes a voice coil frame 116 configured to fix the cup-shaped support 118. The voice coil frame 116 is disposed on a U-shaped yoke 114 fixed on the bottom of the basket 122. Voice coil wires 126 are disposed between the voice coil frame 116 and the U-shaped yoke 114. The speaker 100 further includes a top plate 128 disposed on the U-shaped yoke 114 through a magnet 130, and the voice coil frame 116 surrounds the top plate 128 and the magnet 130. The voice coil frame 116 is connected to the cup-shaped support 118, for example through gluing. In one embodiment, an adhesive 117 is configured to glue the voice coil frame 116 to the cup-shaped support 118, and the adhesive 117 does not go beyond surfaces of the grooves 182. Specifically, the adhesive 117 does not go beyond bottom faces of the grooves 182. The effect that the adhesive 117 does not go beyond the surfaces of the grooves 182 is to avoid causing resistance of airflows flowing in the air passages 180. A position of the adhesive 117 may vary with heights of the protrusion portions 181 and the grooves 182, thereby achieving stable adhesion without causing extra air resistance. Gluing of the adhesive 117 may include annular adhesion (annular adhesive distribution, the adhesive 117 being a full circle surrounding the voice coil frame 116), dotted adhesion (multiple-point adhesive distribution), or banded adhesion (multi-section adhesive distribution).

Figure 8:
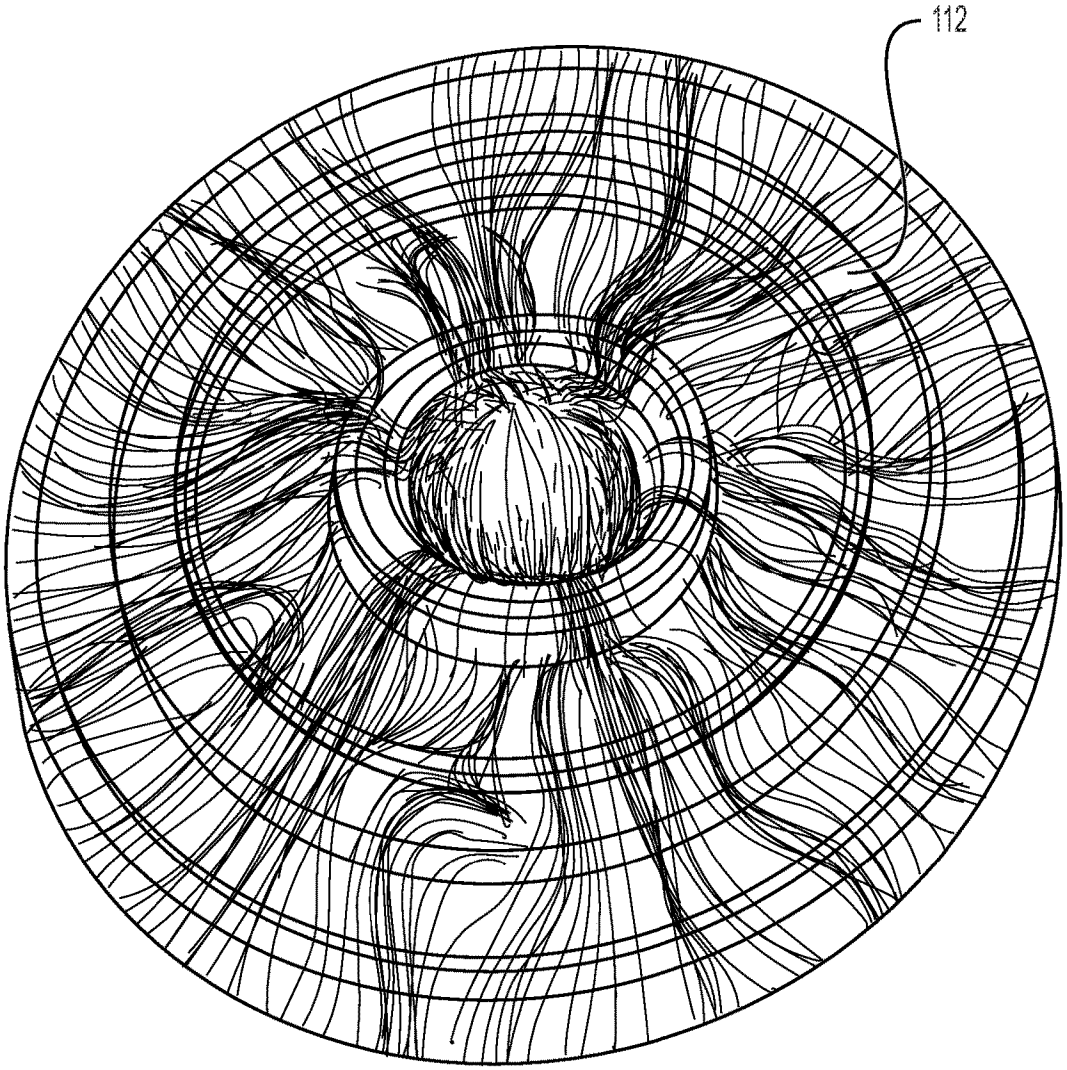
FIG. 8 is a simulated diagram of airflows flowing on the diaphragm according to an embodiment of the present invention.

FIG. 8 shows a flowing state of airflows on the surface of diaphragm 112 according to the embodiment of the present invention. In the prior art, the solution of forming the hole in the voice coil frame 16 and cup-shaped support 18 is adopted. A minimum surface temperature of the diaphragm 12 is 83° C., and a qualified standard for the temperature of the diaphragm is below 60° C. According to the solution of the present invention, the surface temperature of the diaphragm 112 is 57° C. In addition, in the new speaker 100 of the present invention, no holes are formed on the U-shaped yoke 114, which ensures the sound quality and reduces manufacturing cost.

The above descriptions are merely preferred embodiments of the present invention and are not intended to limit the present invention. Those skilled in the art may make various modifications and changes to the present invention. Any modification, equivalent replacement, or improvement made within the spirit and principle of the present invention shall fall within the protection scope of the present invention.

What is claimed is:

1. A speaker, comprising:

a basket;

a surround;

a diaphragm, supported on the basket through the surround; and a voice coil, including a cup-shaped support connected to the basket through a damper, an upper periphery of the cup-shaped support including a plurality of protrusion portions in contact with a lower surface of the diaphragm and a plurality of grooves spaced apart from the diaphragm, wherein the plurality of grooves extends in radial directions of the cup-shaped support to form air passages.

2. The speaker as claimed in claim 1, wherein an end portion of each of the plurality of grooves in the radial directions includes a chamfered structure.

3. The speaker as claimed in claim 1, wherein the diaphragm includes a wall extending downwards from the lower surface, the wall including a plurality of connecting portions in contact with the plurality of protrusion portions of the cup-shaped support.

4. The speaker as claimed in claim 3, wherein the wall further includes a plurality of extension portions extending in the radial directions from two ends of each of the plurality of connecting portions, and the plurality of extension portions being configured to guide airflows flowing through the air passages.

5. The speaker as claimed in claim 1, wherein the plurality of protrusion portions and the plurality of grooves are in an alternate arrangement.

6. The speaker as claimed in claim 5, wherein a distance between two adjacent grooves of the plurality of grooves is fixed.

7. The speaker as claimed in claim 1, wherein a hole is formed on the basket for the air passages.

8. The speaker as claimed in claim 1, wherein the cup-shaped support is formed by a wall extending continuously.

9. The speaker as claimed in claim 1, wherein the voice coil further comprises a voice coil frame configured to fix the cup-shaped support, the voice coil frame being connected to the cup-shaped support through gluing.

10. The speaker as claimed in claim 9, wherein an adhesive configured to glue the voice coil frame to the cup-shaped support does not go beyond surfaces of the plurality of grooves.

* * * * *